United States Patent [19]

Tsujino et al.

[11] 4,294,919

[45] Oct. 13, 1981

[54] DIRECT POSITIVE SILVER HALIDE LIGHT-SENSITIVE MATERIAL

[75] Inventors: Nobuyuki Tsujino; Shigeo Hirano, both of Minami-ashigara, Japan

[73] Assignee: Fuji Photo Film Co., Ltd., Minami-ashigara, Japan

[21] Appl. No.: 156,949

[22] Filed: Jun. 6, 1980

[30] Foreign Application Priority Data

Jun. 6, 1979 [JP] Japan ..... 54-70854

[51] Int. Cl.[3] ..... G03C 1/36

[52] U.S. Cl. ..... 430/559; 430/598; 430/570; 430/578; 430/580; 430/581; 430/592; 430/562; 430/523; 430/589; 430/211; 564/18; 564/27

[58] Field of Search ..... 430/598, 596, 570, 578, 430/580, 581, 592, 559, 562, 523, 589, 211; 260/552 R, 552 SC, 551 S

[56] References Cited

FOREIGN PATENT DOCUMENTS 2851219 6/1979 Fed. Rep. of Germany ..... 430/598

*Primary Examiner*—Won H. Louie, Jr.

*Attorney, Agent, or Firm*—Sughrue, Mion, Zinn, Macpeak & Seas

[57] ABSTRACT

A direct positive silver halide photographic light-sensitive material is described, comprising a support having coated thereon a light-sensitive silver halide photographic emulsion layer and a hydrophilic colloid layer, at least one of said layers containing a compound represented by the formula (I):

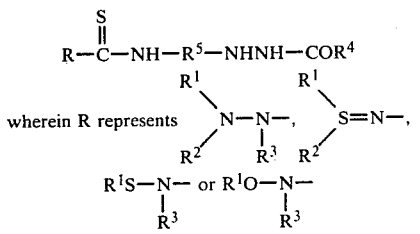

(I)

wherein R represents wherein $R^1$ represents $R^6$ or $R^6CO$—; and $R^6$ represents an aliphatic group, an aromatic group, a heterocyclic aromatic group or hydrogen; $R^2$ and $R^4$, which may be the same or different, each represents an aliphatic group, an aromatic group, a heterocyclic aromatic group or a hydrogen atom; or $R^1$ and $R^2$ together can form a ring; $R^3$ represents hydrogen or an aliphatic group; $R^5$ represents Y or X—A—Y wherein X and Y, which may be the same or different, each represents a divalent aromatic group; and A represents a divalent group selected from —CONH—, —NHCONH—, —$SO_2$NH—, —B—CONH— and —B—$SO_2$NH— wherein B represents —E—, —O—E— or —S—E— wherein O and S is bonded to X; and E represents a divalent aliphatic group; the compound represented by formula (I) is a fogging agent which imparts a desired fogging activity without detracting from spectral sensitization.

20 Claims, No Drawings

DIRECT POSITIVE SILVER HALIDE LIGHT-SENSITIVE MATERIAL

BACKGROUND OF THE INVENTION

1. Field of the Invention

The present invention relates to a silver halide photographic light-sensitive material by which direct positive photographic images are formed and, more particularly, to a photographic light-sensitive material, whose photographic emulsion layers or other hydrophilic colloid layers contain a novel fogging agent.

2. Description of the Prior Art

In the field of silver halide photography, a technique in which positive photographic images are obtained without using a negative image intermediate, or an intermediate process producing a negative image, is called direct positive photography, and photographic light-sensitive materials and photographic emulsions using such a photographic technique are called direct positive light-sensitive materials and direct positive photographic emulsions, respectively.

A variety of direct positive photographic techniques are known. The most useful methods are methods in which silver halide grains which have previously been fogged are exposed to light in the presence of a desensitizer followed by development, and methods comprising exposing a silver halide emulsion containing silver halide grains having light-sensitive specks mainly inside the silver halide grains to light and then developing the exposed emulsion in the presence of a fogging agent. The present invention relates to the latter technique. Silver halide emulsions possessing light-sensitive specks in the inside of the silver halide grains and forming latent images mainly inside the grains are referred to as internal latent image type silver halide grains, and thus are distinguished from silver halide grains which form latent images mainly on the surface of the grains.

A method for obtaining direct positive images by surface-developing an internal latent image type silver halide photographic emulsion in the presence of a fogging agent, and photographic emulsions and photographic light-sensitive materials employed for such a method, are disclosed in U.S. Pat. Nos. 2,456,953, 2,497,875, 2,497,876, 2,588,982, 2,592,250, 2,675,318 and 3,227,552, British Pat. Nos. 1,011,062 and 1,151,363, Japanese Patent Publication No. 29405/68, etc.

In the internal latent image type method for obtaining direct positive images, the fogging agent can be incorporated into a developing solution. However, by incorporating the fogging agent into the photographic emulsion layers or associated layers of the light-sensitive material, thereby absorbing the fogging agent onto the surface of the silver halide grains, better reversal characteristics can be obtained.

Fogging agents which can be employed in the above-described method for obtaining direct positive images include hydrazine and derivatives thereof as described in U.S. Pat. Nos. 2,563,785, 2,588,982 and 3,227,552, respectively. In particular, U.S. Pat. No. 3,277,552 discloses that hydrazide and hydrazine type compounds which are derivatives of hydrazine can be incorporated not only in the developing solution, but also in light-sensitive layers.

However, when hydrazine compounds are incorporated into the emulsion layer, the compounds must be employed in a relatively high concentration (e.g., about 2 g per mol of silver), and, in addition, because the fogging agent is transferred from the emulsion layer to the developing solution during development processing, the concentration of the fogging agent in the emulsion varies and unevenness in the maximum density results in the non-exposed areas, i.e., the fogging effect becomes non-uniform, in the case of multilayer color light-sensitive material, among the different emulsion layers.

Furthermore, it is known that these fogging agents evolve nitrogen gas during fogging. This gas can gather in a film to form gas bubbles, which sometimes imparts damage to the photographic images.

In order to avoid these shortcomings, fogging agents comprising heterocyclic quaternary salt compounds described in U.S. Pat. Nos. 3,615,615, 3,719,494, 3,734,738, 3,759,901, 4,094,683 and 4,115,122, British Patent 1,283,835, Japanese Patent Publication 38164/74, Japanese Patent Application (OPI) Nos. 3426/77 and 69613/77 (The term "OPI" as used herein refers to a "published unexamined Japanese patent application".) have been developed.

However, in most cases, sensitizing dyes are incorporated into the silver halide emulsion for spectral sensitization, and particularly in color light-sensitive materials, layers which are respectively sensitive to green light and red light, in addition to a layer sensitive to blue light, are required. The emulsions in the green sensitive layer and red sensitive layer necessarily contain spectrally sensitizing dyes. In direct positive emulsions, wherein fogging agents are contained together with sensitizing dyes sensitive to green light and red light, competitive adsorption in the silver halide emulsion occurs between the sensitizing dyes and the quaternary salt fogging agent. If a fogging agent in an amount sufficient to form the fogging centers is incorporated into the emulsion, spectral sensitization may be prevented. On the other hand, if a spectrally sensitizing dye in a concentration sufficient to obtain desired spectral sensitization is incorporated into the emulsion, the formation of the fogging center may be prevented.

One means for overcoming this disadvantage, wherein a sensitizing dye having a nucleating substituent in the dye molecule is employed, is disclosed in U.S. Pat. No. 3,718,470.

However, when nucleating activity as well as spectrally sensitizing activity are simultaneously imparted to one molecule, the use of the dye in an appropriate amount for the spectral sensitization may be insufficient for the nucleating activity, and on the other hand, the use of the dye in an amount sufficient for the nucleating activity is inappropriate for the spectral sensitization.

In addition, a disadvantage which is common to the hydrazine type compounds and heterocyclic quaternary salt compounds is their large temperature-dependency for the nucleating activity. That is, if the developing temperature is low, the nucleating activity is low, but if the developing temperature is high, the sensitivity is reduced.

In order to eliminate this disadvantage, it has been proposed in U.S. Pat. No. 4,030,925 (corresponding to German Patent Application (OLS) No. 2,635,316) and U.S. Pat. No. 4,031,127 (corresponding to German Patent Application (OLS) No. 2,635,317) that acyl hydrazinophenylthiourea compounds be employed. These compounds are substantially insoluble in water, and have an extremely low solubility in organic solvents. Thus, in order to incorporate the compounds into a hydrophilic colloid layer such as a light-sensitive layer, the compound is dissolved in a large amount of organic solvent, and the solution is added to a solution of a hydrophilic colloid. However, when a large amount of organic solvent is added to a solution of a hydrophilic colloid, the deposition or aggregation of the hydrophilic colloid (e.g., gelatin) tends to occur, and, when such a solution of a hydrophilic colloid is coated on a support, the coatings are uneven, and deposits or aggregates may be present in the colloid layer. The quality of light-sensitive materials is thus extremely degraded. Accordingly, the incorporation of fogging agent into a hydrophilic colloid layer using as small an amount of organic solvent as possible is required, and thus, it is desirable that the fogging agent possess a high solubility in a solvent.

SUMMARY OF THE INVENTION

Accordingly, a first object of this invention is to provide a direct positive photographic light-sensitive material in which adequate spectral sensitization is provided and direct positive images having uniform and high maximum density are produced.

A second object of the present invention is to provide a direct positive photographic light-sensitive material which does not contaminate the developing solution.

A third object of the present invention is to provide a direct positive photographic light-sensitive material having less dependency upon the developing temperature.

A fourth object of the present invention is to provide a direct photographic light-sensitive material having a uniform hydrophilic colloid layer free from coating uneveness, and providing images having good qualities, using a fogging agent which has a high solubility in a solvent.

A fifth object of the present invention is to provide a color diffusion transfer photographic light-senstive material which has the aforementioned various properties.

The aforementioned objects of the present invention are achieved by incorporating a fogging agent represented by formula (I), as set forth below, into at least one hydrophilic colloid layer in a silver halide light-sensitive material, preferably an internal latent image type silver halide photographic emulsion layer or an adjacent hydrophilic colloid layer:

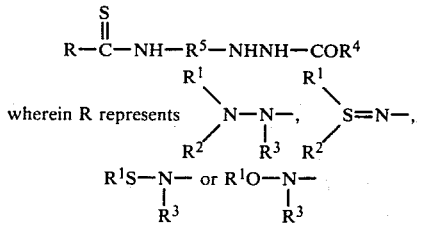

and $R^6$ represents an aliphatic group, an aromatic group, a heterocyclic aromatic group or hydrogen; $R^2$ and $R^4$, which may be the same or different, each represents an aliphatic group, an aromatic group, a heterocyclic aromatic group or hydrogen; or $R^1$ and $R^2$ together can form a ring; $R^3$ represents a hydrogen atom or an aliphatic group; $R^5$ represents Y or X—A—Y wherein X and Y, which may be the same or different, each represents a divalent aromatic group; and A represents a connecting group such as —CONH—, —NHCONH—, —$SO_2$NH—, —B—CONH— or —B—$SO_2$NH— wherein B represents —E—, —O—E— or —S—E— wherein the O and S is bonded to X; and E represents a divalent aliphatic group.

DETAILED DESCRIPTION OF THE INVENTION

In more detail, the aliphatic group for $R^6$ and $R^2$ can include a straight chain or branched chain alkyl group, a cycloalkyl group, and these groups can be substituted, such as with an alkenyl group or an alkynyl group. The straight chain or branched chain alkyl group can, for example, be an alkyl group having from 1 to 18 carbon atoms, and more preferably from 1 to 8 carbon atoms. Specific examples thereof include a methyl group, an ethyl group, an isobutyl group, a t-octyl group, and so forth.

The cycloalkyl group can comprise, for example, 3 to 10 carbon atoms; specific examples thereof including a cyclopropyl group, a cyclohexyl group, an adamantyl group, and so forth.

Examples of the substituents for such alkyl groups include an alkoxy group (for example, a methoxy group, an ethoxy group, a propoxy group, a butoxy group, etc.), a halogen atom (for example, a chlorine atom, a bromine atom, a fluorine atom, a iodine atom, etc.), an alkoxycarbonyl group, an aryl group (for example, a phenyl group, a halogen-substituted phenyl group, an alkoxyphenyl group, an alkylphenyl group, etc.), and so forth. Specific examples of the substituted alkyl groups includes, for example, a 3-methoxypropyl group, 4-chlorocyclohexyl group, a benzyl group, a p-methylbenzyl group, a p-chlorobenzyl group, and so forth.

Furthermore, the alkenyl group may include, for example, an allyl group, and the alkynyl group may include, for example, a propargyl group.

On the other hand, the aromatic group for $R^6$ and $R^2$ can be a phenyl group and a naphthyl group, both of which may bear a substituent (for example, an alkyl group, an alkxoy group, a dialkyl amino group, an alkoxycarbonyl group, a cyano group, a halogen atom, etc.). Specific examples of the substituted aryl groups includes, for example, a p-methoxyphenyl group, a tolyl group, a p-chlorophenyl group, an m-fluorophenyl group, and so forth.

The heterocyclic aromatic group for $R^6$ and $R^2$ can also be a 5-membered or 6-membered ring containing at least one of an oxygen atom, a nitrogen atom and a sulfur atom, or a condensed ring. The group may bear a substituent. Specific examples of the heterocyclic aromatic group include, for example, furan, pyrrole, thiophene, thiazole, oxazole, imidazole, triazole, thiadiazole, tetrazole, pyridine, pyrimidine, triazine, benzothiazole, benzoxazole, and so forth. Examples of the substituents on such group can include an alkyl group, an alkoxy group, a halogen atom, an alkoxycarbonyl group, a cyano group, an amido group, and so forth.

Specific examples of the condensed ring are heterocyclic rings condensed with an aromatic ring such as benzene or naphthalene.

When $R^1$ and $R^2$ together form a ring, $R^1$ and $R^2$ together represent, for example, tetramethylene, pentamethylene, hexamethylene, dodecamethylene, 3-oxapentamethylene, 3-methyl-3-azapentamethylene, and so forth.

The aliphatic group for $R^3$ includes a straight chain or branched chain alkyl group, a cycloalkyl group and these groups having a substituent. The straight chain or branched chain alkyl group can, for example, be an alkyl group having from 1 to 12 carbon atoms, and more preferably has from 1 to 8 carbon atoms. Specific examples thereof include a methyl group, an ethyl group, an isobutyl group, etc. Further, the cycloalkyl group can comprise, for example, from 3 to 10 carbon atoms; specific example thereof including a cyclohexyl group.

Examples of the substituents include an alkoxy group, an alkoxycarbonyl group, an aryl group, an amido group, an acyloxy group, etc. Specific examples of the substituted alkyl groups are, for example, a 3-methoxypropyl group, a benzyl group, and so forth.

$R^4$ represents a hydrogen atom, an aliphatic group, an aromatic group or a heterocyclic aromatic group.

The aliphatic group for $R^4$ may be a straight chain or branched chain alkyl group, a cycloalkyl group, and these groups may have as a substituent an alkenyl group or an alkynyl group. The straight chain or branched chain alkyl group can, for example, be an alkyl group having from 1 to 18 carbon atoms, and more preferably has from 1 to 8 carbon atoms. Specific examples thereof include a methyl group, an ethyl group, an n-propyl group, an isopropyl group, an isobutyl group, etc. Further, the cycloalkyl group comprises, for example, from 3 to 10 carbon atoms; specific examples thereof include a cyclopropyl group, a cyclohexyl group, an adamantyl group, etc. Examples of the substituents include an alkoxy group (for example, a methoxy group, etc.), a halogen atom, an alkoxycarbonyl group, an aryl group (for example, a phenyl group, etc.), a substituted aryl group (for example, a halogen-substituted phenyl group, etc.), a cyano group, an amido group, an acyloxy group, a carbamoyl group, etc. Specific examples of the substituted alkyl groups include, for example, a 3-methoxypropyl group, a benzyl group, a 4-chlorocyclohexyl group, a trifluoromethyl group, etc. The alkenyl group includes, for example, an allyl group, and the alkynyl group includes, for example, a propargyl group.

The aromatic group for $R^4$ can also be a phenyl group and a naphthyl group both of which may bear a substituent. Examples of the substituents include an alkyl group, an alkoxy group, a halogen atom, an alkoxycarbonyl group, a cyano group, a carboxy group, a sulfonyl group, an amido group, etc. Specific examples of the substituted aryl groups include, for example, a 4-chlorophenyl group, a 4-cyanophenyl group, a 4-carboxyphenyl group, etc.

The heterocyclic aromatic group for $R^4$ is a heterocyclic ring same as defined for $R^6$ and $R^2$.

Of these groups for $R^4$, a hydrogen atom, a methyl group and a phenyl group which may be substituted are preferred. A hydrogen atom is particularly preferred.

$R^5$ represents Y or X—A—Y wherein X and Y, which may be the same or different, each represents a divalent aromatic group. The divalent aromatic group for Y includes a phenyl group and a naphthyl group, which may bear a substituent. Examples of the substituents include an alkyl group having from 1 to 20 carbon atoms which may be branched, an aralkyl group having from 1 to 3 carbon atoms in the alkyl moiety, an alkoxy group having from 1 to 20 carbon atoms, a substituted alkoxy group, an amino group substituted with an alkyl group or a substituted alkyl group, an amido group, a halogen atom, a cyano group, an akoxycarbonyl group, an acyloxy group, a carbamoyl group, a sulfo group, and so forth.

A represents a divalent connecting group, for example, —CONH—, —NHCONH—, —$SO_2$NH—,—B—CONH—, —B—$SO_2$NH—, etc., wherein B represents —E—, —OE—or —SE—, and the O and S atom therein is bonded to the group represented by X. E represents a divalent aliphatic group and includes a straight chain or branched chain alkylene group and cycloalkylene group and further includes a group containing a double bond or a triple bond besides a saturated bond. Examples of the straight chain or branched chain alkylene groups for R can include an alkylene group having from 1 to 5 carbon atoms, and more preferably from 1 to 3 carbon atoms. Specific examples thereof include, for example, —$CH_2$—, —$CH_2CH_2$—, —$CH_2CH_2CH_2$—, —$CH(CH_3)$—, and —$CH(CH_2CH_3)$—. Examples of the cycloalkylene groups for R include a cycloalkylene group having from 3 to 6 carbon atoms. Specific examples thereof are a 1,2-cyclopropylene group, a 1,4-cyclohexylene group, etc. Specific examples of the groups containing an unsaturated bond include —CH=CH—, —C≡C—, and so forth.

Of the groups defined above for X and Y, a phenylene group having two bonding sites at the meta or para positions is preferred.

When a fogging agent according to the invention is employed, the following effects can be obtained.

(1) The temperature-dependency of the processing condition is lessened.

(2) No deterioration of images due to evolution of nitrogen gas is encountered.

(3) The amount of the fogging agent employed is reduced.

(4) The adsorption capability of the silver halide is strong, so that fogging activity effectively occurs. (Thus the amount of fogging agent employed may be reduced, and spectral sensitization is not damaged.)

(5) Visible light is not absorbed; thus desensitization does not occur.

(6) Solubility in a solvent is large so that the fogging agent can be incorporated into a hydrophilic colloid layer using a small amount of organic solvents, and, thus, a uniform hydrophilic colloid layer free from unevenness, deposits and aggregates is obtained.

Specific examples of the fogging agents which are effective in the present invention are illustrated below. However, the present invention is not limited to the use of these compounds.

Compound 1: 4-[4-(2-Formylhydrazino)phenyl]-1-methyl-b 1-phenylthiosemicarbazide Compound 2: 1,1-Dimethyl-4-[4-(2-formylhydrazino)phenyl]thiosemicarbazide Compound 3: 4-[4-(2-Formylhydrazino)phenyl]-1-phenylthio semicarbazide Compound 4: 4-[4-(2-Benzoylhydrazino)phenyl]-1-(4-nitrobenzoyl) thiosemicarbazide Compound 5: 4-[3-(2-Acetylhydrazino)phenyl]-1-methyl-1-phenylthiosemicarbazide Compound 6: 4-{3-[4-(2-Formylhydrazino)phenylcarbamoyl]phenyl}-1,1-pentamethylenethiosemicarbazide Compound 7: 4-{3-[4-(2-Formylhydrazino)phenylsufamoyl]phenyl}-1,1-dimethylthiosemicarbazide Compound 8: 4-{4-[4-(2-Formylhydrazino)phenylcarbamoylmethoxy]phenyl}-1,1-dibutylthiosemicarbazide Compound 9: N-{N-[4-(2-Formylhydrazino)phenyl]thiocarbamoyl}diphenylsulfylimine Compound 10: N-{N-[4-(2-Formylhydrazino)phenyl]thiocarbamoyl}benzenesulfenamide Compound 11: N-{N-[4-(2-Formylhydrazino)phenyl]thiocarbamoyl}-N-methylbenzenesulfenamide Compound 12: 1-Ethoxy-3-[4-(2-formylhydrazino)-phenyl]thiourea A general synthetic method for forming the fogging agent employed in the present invention is described below. By reacting 4- or 3-nitrophenylhydrazine with formic acid or a corresponding acid anhydride or acid chloride, 1-formyl-2-(4- or 3-nitrophenyl)hydrazine or the corresponding 1-acyl-2-(4- or 3-nitrophenyl)hydrazine can be obtained. By catalytically reducing with hydrogen gas the nitrophenylhydrazides in a solvent such as an alcohol, for example, ethanol, methyl Cellosolve, etc., or dioxane, in the presence of palladium-carbon as a catalyst, or by heating the nitrophenylhydrazides with reduced iron in an alcohol containing water, in the presence of ammonium chloride as a catalyst, a corresponding 4- or 3-aminophenylhydrazine can be readily obtained.

(1) Where $R^5$ is Y in the general formula (I), the above described amino compound is reacted with carbon disulfide in a solvent such as an alcohol, for example, methanol, ethanol, etc. or an ether, for example, dioxane, etc., in the presence of a base, for example, sodium hydroxide, a tertiary amine, etc. to prepare a dithiocarbamic acid derivative, and the latter is treated with dicyclohexylcarbodiimide or ethyl chloroformate to obtain an acylhydrazino phenylisothiocyanate. The phenylisothiocyanate is then reacted with an amine, such as a hydrazine, a sulfylimine, a sulfenamide, a hydroxylamine derivative, to synthesize Compound (I), Also, the acylhydrazino phenylisothiocyanate is synthesized by reacting the above described amino compound with thiophosgene in the presence of an acid-eliminating agent, for example, sodium hydrogen carbonate, calcium carbonate, a trialkyl amine.

(2) Where $R^5$ is X—A—Y in the general formula (I), the above described amino compound is reacted with an acid chloride in which the 4-position or 3-position of a benzene ring is substituted with a nitro group (examples of the acid chlorides being benzoic acid chloride, benzenesulfonic acid chloride, a phenyl fatty acid chloride, a phenoxy fatty acid chloride, a phenyl thiofatty acid chloride, etc.) in the presence of an acid-eliminating agent, for example, triethyl amine, pyridine, etc. to prepare a corresponding nitro compound. After converting the nitro group into an amino group by catalytic reduction or with reduced iron as described above, the amino compound is treated in the manner as described in (1) above to obtain a corresponding fogging agent.

Specific synthesis examples are illustrated below.

The starting materials, viz., 2-(4-aminophenyl) -1-formylhydrazine, 2-(3-aminophenyl) -1-formylhydrazine, 2-(4-aminophenyl)-1-benzoylhydrazine and 2-[4-(3-aminobenzamido)phenyl]-1-formylhydrazine were synthesized by the method described in Japanese Patent Application No. 142469/77 and 2-{4-[3-(4-aminophenoxy)propionamido]phenyl}1-formylhydrazine and 2-{4-[2-(3-aminophenyxy)acetamido]phenyl}-1-formylhydrazine were synthesized by the method described in Japanese Patent Application No. 40621/78.

(1) 1-Formyl-2-[4-(3-nitrobenzenesulfonamido)-phenyl]hydrazine 15.1 g of 2-(4-aminophenyl)-1-formylhydrazine and 14 ml of triethylamine were dispersed in 50 ml of acetonitrile. To the dispersion, a solution containing 50 ml of acetonitrile and 22.1 g of 3-nitrobenzenesulfonyl chloride was added dropwise while stirring at room temperature. After heating at 60° C. for 2 hours, the reaction mixture was cooled and then poured into water. The resulting crystals were collected by filtration. 15 g of the object compound was obtained.

Melting Point: 188° to 191° C.

(2) 4-(2-Formylhydrazine)phenylisothiocyanate 38 g of 2-(4-aminophenyl)-1-formylhydrazine and 31 g of triethylamine were dissolved in 250 ml of methanol. To the solution, 23 g of carbon disulfide was added while stirring under cooling with ice. After reacting under cooling with ice for 1 hour, 30 g of ethyl chloroformate was added to the reaction mixture. After reacting under cooling with ice for 30 minutes and at 27° C. for 1.5 hours, 500 ml of water was added to the reaction mixture and the crystals formed were collected by filtration. The crystals were dissolved in 600 ml of acetonitrile. The solution was treated with 2.5 g of active carbon and filtered. By crystallization from the filtrate, 29 g of the object compound was obtained.

Melting Point: 178° to 179° C. (decom.).

(3) 3-[4-(2-Formylhydrazino)phenylcarbamoyl]-phenylisothiocyanate 51 g of 2-[4-(3-aminobenzamido)phenyl]-1-formylhydrazine and 29 g of calcium carbonate were dispersed in a mixture of 120 ml of dioxane and 120 ml of water. To the dispersion, 25 g of thiophosgene was added under cooling with ice. After reacting under cooling with ice for 3 hours, the crystals deposited were collected by filtration to obtain 42 g of the object compound.

Melting Point: above 290° C.

(4) Compound 1

3.9 g of 4-(2-formylhydrazino)phenylisothiocyanate and 2.9 g of 1-methyl-1-phenylhydrazine were dissolved in 40 ml of methanol and reacted at 40° C. for 2.5 hours. To the reaction liquid, 300 ml of benzene and 200 ml of water were added to separate an oil. The oil was collected by decantation and purified by a silica gel column chromatography (using a mixture of benzene and acetonitriel (2:1) as a spreading agent) to obtain 5.0 g (yield: 79%) of the object compound.

Melting Point: 109° to 115° C. (decomp.)

(5) Compound 2

5.8 g of 4-(2-formylhydrazino)phenylisothiocyanate and 3.0 g of 1,1-dimethylhydrazine were dissolved in 50 ml of acetonitrile and reacted at 40° C. for 3 hours. The reaction liquid was cooled with ice to crystallize. The crystals formed were collected by filtration and recrystallized from 130 ml of acetonitrile to obtain 5.4 g of the object compound.

Melting Point: 177° to 178° C. (decomp.)

(6) Compound 3

5.8 g of 4-(2-formylhydrazino)phenylisothiocyanate and 3.6 g of phenylhydrazine were dissolved in 100 ml of acetonitrile and reacted at 25° C. for 2 hours. The crystals formed were collected by filtration and recrystallized from acetonitrile to obtain 5.2 g of the object compound.

Melting Point: 168° to 169° C. (decomp.)

(7) Compound 9

3.9 g of 4-(2-formylhydrazino)phenylisothiocyanate and 2.0 g of diphenylsulfylimine were dissolved in 20 ml of methanol and reacted at 40° C. for 3 hours. After removing the solvent under reduced pressure, the group was purified by a silica gel column chromatography (using a mixture of benzene and acetonitrile (2:1) as a spreading agent) to obtain 2.1 g of the object compound.

Melting Point: 95° to 98° C. (decomp.)

(8) Compound 12

5.8 g of 4-(2-formylhydrazino)phenylisothiocyanate and 3.0 g of ethoxyamine hydrochloride were dispersed in 70 ml of acetonitrile. To the dispersion, 3.1 g of triethylamine was added dropwise with stirring. After reacting at 40° C. for 4 hours, the solvent was removed under reduced pressure. The group was purified by a silica gel column chromatography (using a mixture of benzene and acetonitrile (1:1) as a spreading agent) to obtain 3.5 g of the object compound.

Other compounds can be synthesized in a manner analogous to the above synthesis examples.

In the direct positive light-sensitive material of the present invention, it is preferred that the compound represented by the formula (I) be incorporated into an internal latent image type silver halide emulsion. However, the compound can also be incorporated into a hydrophilic colloid layer contiguous to an internal latent image type silver halide emulsion layer. Such a layer can be any layer of a light-sensitive layer, an intermediate layer, a filter layer, a protective layer, an antihalation layer, etc., having any function, as long as the fogging agent is not prevented from diffusing into the internal latent image type silver halide emulsion.

It is desired that the fogging agent of the present invention in the layer(s) be present in an amount that results in a suitable maximum density (for example, above 2.0) when the internal latent image type emulsion is developed by a surface developing solution. For practical purposes, the appropriate content will vary over a wide range, depending upon the characteristics of silver halide emulsion, the chemical structure of the fogging agent and the developing conditions. Nevertheless, a range of from about 0.1 mg to 1,000 mg per mol of silver halide in the internal latent image type silver halide emulsion is practically effective, and more preferably is from 0.5 mg to 700 mg per mol of silver halide. Where the fogging agent is incorporated into the hydrophilic colloid layer contiguous to the emulsion layer, it is adequate to incorporate the fogging agent in the above amount, based on consideration of the amount of silver contained in the associated internal latent image type emulsion layer.

The fogging agent of the present invention can be used in combination with other type of fogging agent(s), e.g., a hydrazide or hydrazine type compound and a heterocyclic quaternary salt compound as described hereinbefore. The molar ratio of the other type of fogging agent(s) to the compound of formula(I) is suitable to be within the range of from about 1 to about 500, preferably 10 to 300.

Internal latent image type silver halide emulsions are already shown by Davey et al (U.S. Pat. No. 2,592,250) and described in other references. The internal latent image type silver halide emulsion can be clearly distinguished by the fact that the maximum density achieved in the case of developing it with an "internal type" developing solution is greater than the maximum density achieved in the case of developing it with a "surface type" developing solution. The internal latent image type emulsion which is suitable for the present invention has a maximum density (measured by an ordinary photographic density measurement methods) when coated onto a transparent support and exposed to light a fixed time period of between 0.01 to 1 second and then developed with Developing Solution A indicated below (an internal type developing solution) at 20° C. for 3 minutes, greater by at least 5 times than the maximum density obtained in the case of developing the silver halide exposed as described above with Developing Solution B indicated below (a surface type developing solution) at 20° C. for 4 minutes.

| Developing Solution A: | |
|---|---|
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 l |

| Developing Solution B: | |
|---|---|
| p-Oxyphenylglycine | 10 g |
| Sodium Carbonate | 100 g |
| Water to make | 1 l |

As internal latent image type emulsions which are suitable for the objects of the present invention, the emulsions described in British Pat. No. 1,027,146, U.S. Pat. Nos. 3,206,313, 3,511,662, 3,447,927, 3,737,313, 3,761,276, 3,271,157, etc., can be employed, in addition to the emulsion described in U.S. Pat. No. 2,592,250 referred to above. However, the emulsions of the present invention are not limited to these.

In the direct positive photographic light-sensitive material of the present invention, a variety of hydrophilic colloids can be employed as a binder.

As colloids employed for this purpose, hydrophilic colloids conventionally employed in the photographic field can be used, such as gelatin, colloidal albumin, polysaccharides, cellulose derivatives, synthetic resins, polyvinyl compounds including, e.g., polyvinyl alcohol derivatives, acrylamide polymers, etc. Hydrophobic colloids, e.g., dispersed polymerized vinyl compounds, particularly those that increase dimensional stability of photographic materials, can also be incorporated together with the hydrophilic colloid. Suitable examples of this type of compounds include water-insoluble polymers prepared by polymerizing vinyl monomers such as alkyl acrylates, alkyl methacrylates, acrylic acid, sulfoalkyl acrylates, sulfoalkyl methacrylates, and so forth.

A variety of photographic supports can be employed in the light-sensitive material of the present invention. The silver halide emulsion can be coated onto one side or both sides of the support.

In the light-sensitive material of the present invention, the photographic silver halide emulsion layers and other hydrophilic colloid layers can be hardened with an appropriate hardening agent. Examples of these hardening agents include vinylsulfonyl compounds, as described in Japanese Patent Application Nos. 151636/76, 151641/76 and 154494/76, hardening agents having active halogen, dioxane derivatives, oxypolysaccharides such as oxy starch, and so forth.

The photographic silver halide emulsion layer can contain other additives, particularly those useful for photographic emulsions, e.g., lubricants, stabilizers, sensitizers, light absorbing dyes, plasticizers, etc.

In addition, in the present invention compounds which release iodine ions (such as potassium iodide) can be incorporated into the silver halide emulsion and, furthermore, the desired image can be obtained using a developing solution containing iodine ions.

The light-sensitive material of the present invention can contain surface active agents for a variety of purposes. Depending upon purpose, any one of nonionic, ionic and amphoteric surface active agents can be employed, which are exemplified by, e.g., polyoxyalkylene derivatives, amphoteric amino acids (including sulfobetaines), etc. Examples of such surface active agents are described in U.S. Pat. Nos. 2,600,831, 2,271,622, 2,271,623, 2,275,727, 2,787,604, 2,816,920 and 2,739,891, Belgian Pat. No. 652,862, etc.

In the light-sensitive material of the present invention, the photographic emulsion can be spectrally sensitized with sensitizing dyes to blue light of relatively long wavelengths, green light, red light or infrared light. As sensitizing dyes, there can be employed cyanine dyes, merocyanine dyes, complex cyanine dyes, complex merocyanine dyes, holopolar cyanine dyes, styryl dyes, hemicyanine dyes, oxonol dyes, hemioxonol dyes, etc.

Useful sensitizing dyes which can be employed in accordance with the present invention are described, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 2,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 3,526,632 and 2,503,776, Japanese Patent Application (OPI) No. 76525/73, Belgian Pat. No. 691,807, etc.

The sensitizing dyes employed in the present invention are used in a concentration almost equivalent to that used in ordinary negative silver halide emulsion. In particular, it is advantageous that the sensitizing dyes be employed in a dye concentration to a degree that does not substantially cause desensitization in the region of intrinsic sensitivity of the silver halide emulsion. It is preferred that the sensitizing dyes be employed in a concentration of from about $1.0\times10^{-5}$ to $5\times10^{-4}$ mol per mol of silver halide, and particularly in a concentration of from $4\times10^{-5}$ to $2\times10^{-4}$ mol per mol of silver halide.

Dye image-forming couplers can be incorporated into the light-sensitive material of the present invention. Alternatively, the light-sensitive material can also be developed with a developing solution containing a dye image-forming coupler. In order to incorporate a color forming agent into the silver halide emulsion of the present invention, known methods can optionally be employed. For example, methods as described in U.S. Pat. Nos. 1,055,155, 1,102,028, 2,186,849, 2,322,027 and 2,801,171 can be employed. In the present invention, developing agents, e.g., polyhydroxybenzenes, aminophenols, 3-pyrazolidones, etc., can also be incorporated in emulsion or light-sensitive material. In the present invention, the photographic emulsion can be unhardened, or can also contain tanning developing agents such as hydroquinone, catechol, etc.

The photographic emulsion of the present invention can also be utilized for obtaining desired transfer images on an image-receiving layer after appropriate development processing, in combination with a dye image-providing material for diffusion transfer capable of releasing diffusible dyes in response to development of silver halide. As such a dye image-providing material for diffusion transfer, a number of compounds are known and such as the compounds described in, for example, U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, and 4,013,635, Published U.S. Patent Application Ser. No. B 351,673, British Pat. Nos. 840,731, 904,364 and 1,038,331, German Patent Application (OLS) Nos. 1,930,215, 2,214,381, 2,228,361, 2,317,134 and 2,402,900, French Pat. No. 2,284,140, Japanese Patent Application (OPI) No. 113624/76 (corresponding to U.S. Pat. No. 4,055,428) and Japanese Patent Application (OPI) Nos. 104343/76, 149328/78 and 143323/78, can be employed. Of these, it is preferred that dye image-providing materials of types which are at first non-diffusible, and, after the oxidation-reduction reaction with the oxidation product of the developing agent, cleave to release diffusible dyes (hereafter referred to as DRR compounds) be employed.

In particular, preferred compounds for use in combination with the fogging agent of the present invention are DRR compounds having an o-hydroxyarylsulfamoyl group as described in Japanese Patent Application (OPI) No. 113624/76, 149328/78, 65034/79, 36804/80, 161332/79 and 4028/80, Japanese Patent Application Nos. 89128/79, 90806/79, 91187/79, 148237/79, 69488/78, 76162/78, 96445/78, 42848/79, 149777/79, 146655/79 and 146654/79. If the fogging agent is employed in combination with such DRR compounds, the temperature dependency of processing is markedly reduced.

Specific examples of DRR compounds include, in addition to those as described in the above-described patent publications, 1-hydroxy-2-tetramethylenesulfamoyl-4-[3′-methyl-4′-(2″-hydroxy-4″-methyl-5″-hexadecyloxyphenylsulfamoyl)phenylazo]naphthalene as a magenta dye-forming substance, 1-phenyl-3-cyano-4-{3′-[2′-hydroxy-4″-methyl-5″-(2′″,4′″-di-t-pentylphenoxyacetamino)phenylsulfamoyl]phenylazo}-5-pyrazolone as a yellow dye image-forming substance, etc.

For developing the light-sensitive material of the present invention, a variety of known developing agents can be employed. That is, polyhydroxybenzenes, e.g., hydroquinone, 2-chlorohydroquinone, 2-methylhydroquinone, catechol, pyragallol, etc.; aminophenols, e.g., p-aminophenol, N-methyl-p-aminophenol, 2,4-diaminophenol, etc.; 3-pyrazolidones, e.g., 1-phenyl-3-pyrazolidones, 4,4-dimethyl-1-phenyl-3-pyrazolidone, 5,5-dimethyl-1-phenyl-3-pyrazolidone, etc.; ascorbic acids, and the like can be employed singly or as combination thereof. In addition, to obtain dye images in the presence of dye-forming couplers, aromatic primary amine developing agents, preferably p-phenylenediamine type developing agents can be used. Specific examples thereof include 4-amino-3-methyl-N,N-diethylaniline hydrochloride, N,N-diethyl-p-phenylenediamine, 3-methyl-4-amino-N-ethyl-N-β-(methanesulfonamido)ethylaniline, 3-methyl-4-amino-N-ethyl-N-(β-sulfoethyl)aniline, 3-ethoxy-4-amino-N-ethyl-N-(β-sulfoethyl)aniline, 4-amino-N-ethyl-N-(β-hydroxyethyl)aniline. Such developing agents can be incorporated into alkaline processing compositions (processing element) or can also be incorporated into appropriate layers of the light-sensitive element.

In the case of using a DRR compound in this invention, any silver halide developing agent can be employed, as long as the agent is able to cross-oxidize the DRR compounds.

The developing solution can contain, as a preservative, sodium sulfite, potassium sulfite, ascorbic acid, reductones (e.g., piperidinohexose reductone), etc.

The light-sensitive material of the present invention can provide direct positive images by developing the material using a surface developing solution. The surface developing solution induces the development process substantially with latent images or fogging nuclei present on the surface of silver halide grains. Though it is preferred not to contain any silver halide dissolving agent in the developing solution, a small amount of the silver halide dissolving agent (e.g., sulfites) can be contained in the developing solution as long as internal latent images do not substantially contribute to development until the development due to the surface development center of silver halide grains is completed.

The developing solution can contain, as an alkali agent and a buffering agent, sodium hydroxide, potassium hydroxide, sodium carbonate, potassium carbonate, trisodium phosphate, sodium metaborate, etc. The amount of these agents is selected so as to result in a pH of the developing solution of from 10 to 14, and preferably pH to 11 to 13.

The developing solution can also contain color development accelerators such as benzyl alcohol, or the like. Further, it is advantageous that the developing solution contains, in order to lessen the reduction in the minimum density of direct positive images, compounds which are usually employed as anti-fogging agents, for example, benzimidazoles, e.g., 5-nitrobenzimidazole; benzotriazoles, e.g., benzotriazole, 5-methylbenzotriazole, etc.

The light-sensitive material of the present invention can also be processed with a viscous developing solution.

The viscous developing solution is a liquid state composition in which processing components necessary for development of silver halide emulsion and for formation of diffusion transfer dye images are contained; a major component of the solvent is water and in addition thereto, hydrophilic solvents such as methanol, methyl Cellosolve, etc., are contained therein in some cases. The processing composition contains an alkali in an amount sufficient to maintain a pH necessary for developing the emulsion layer(s) and to neutralize acids (e.g., hydrohalic acids such as hydrobromic acid, carboxylic acids such as acetic acid, etc.) formed during various processings for development and formation of dye images. As alkalis, alkali metal or alkaline earth metal salts may be employed, or amines such as lithium hydroxide, sodium hydroxide, potassium hydroxide, calcium hydroxide dispersion, hydroxylated tetramethyl ammonium, sodium carbonate, trisodium phosphate, diethyl amine, and so forth. It is desired that alkali hydroxides be incorporated in the developing solution in such an amount as to result in a pH, preferably, of about 12 or more at room temperature, and preferably a pH of 13 or more for color diffusion transfer photography. More preferably, the processing composition also contains hydrophilic polymers of high molecular weight, such as polyvinyl alcohol, hydroxyethyl cellulose, sodium carboxymethyl cellulose. It is desired that these polymers be employed so as to impart viscosity above 1 poise at room temperature, and preferably several hundred (500 to 600) to 1,000 poise, to the processing composition.

Furthermore, it is advantageous particularly in the case of a mono sheet film unit that the processing composition contain light absorbing agents such as $TiO_2$, carbon black, pH-indicating dyes for preventing the silver halide emulsion from fogging due to outside light during or after processing, or desensitizers as described in U.S. Pat. No. 3,579,333. In addition, developing inhibitors such as benzotriazole can be incorporated into the processing composition.

It is preferred that the above-described processing composition be employed in a rupturable container as described in U.S. Pat. Nos. 2,543,181, 2,643,886, 2,653,732, 2,723,051, 3,056,491, 3,056,492, 3,152,515, etc.

Where the light-sensitive material of the present invention is employed for diffusion transfer photography, it is preferred that the light-sensitive material be in the form of a film unit. A photographic film unit, that is, a film unit designed so as to enable processing by passing the film unit between a pair of side-by-side disposed pressing materials, basically comprises the three elements below:

(1) a light-sensitive element containing the fogging agent of the present invention, (2) an image-receiving element, and (3) a processing element, e.g., which contains a means for releasing the alkaline processing composition in the film unit such as a rupturable container and contains the silver halide developing agent.

A preferred embodiment of this photographic film unit is a type unified by laminating and the type disclosed in Belgian Pat. No. 757,959. According to this embodiment, the film unit comprises a transparent support having coated thereon, in succession, an image-receiving layer, a substantially opaque light reflective layer (e.g., a $TiO_2$ layer and a carbon black layer), and a light-sensitive element comprising single or plural silver halide light-sensitive layers in combination with DRR compounds, and further thereon laminated a transparent cover sheet. A rupturable container containing an alkaline processing composition comprising an opacifying agent (e.g., carbon black) is disposed adjacent to the outermost layer of the above-described light-sensitive layers and the transparent cover sheet. Such a film unit is exposed to light through the transparent cover sheet, and upon taking the unit out of a camera, the container is ruptured by pressing materials, to thereby spread the processing composition, containing the opacifying agent, over the entire surface between a protective layer on the light-sensitive layers and the cover sheet. By doing this, the film unit is shielded from light as development proceeds. It is preferred that a neutralizing layer and further, if necessary, a neutralizing rate controlling layer (timing layer) be coated, in succession, onto a support of the cover sheet.

In addition, other useful embodiments, utilizing laminate layers in which DRR compounds or diffusible dye releasing couplers are employed, are described in U.S. Pat. Nos. 3,415,644, 3,415,645, 3,415,646, 3,647,487 and 3,635,707, German Patent Application (OLS) No. 2,426,980, etc.

The present invention will be further explained by reference to the examples below. However, the present invention is not limited thereto.

EXAMPLE 1

Using Compounds 1, 2, 3 and 9 described hereinbefore according to this invention, and Compound A: 1-(4-(2-formylhydrazino)phenyl]-3-phenylthiourea which is described in U.S. Pat. No. 4,030,925, a comparison of solubility was carried out.

Methanol, ethanol and acetone were selected as solvents. The solvent was placed in a measuring flask in an amount of 100 ml. Then each of compounds 1, 2, 3, 9 and A was added to the measuring flask, in an amount ranging from 0.01 g to 10 g. The measuring flasks were put into an ultrasonic washing machine ("Cleaner, Ultrasonic 220" manufactured by Branson Co.) and ultrasonic wave was applied thereto for 5 minutes to promote dissolution of the compound, except for the measuring flasks in which dissolution of the compound was visually observed at room temperature (about 25° C.) just after the addition of the compound. The temperature of the solvent rose slightly due to the application of ultrasonic waves. After the application of ultrasonic waves, the measuring flasks were taken from the ultrasonic washing machine, and whether the compound dissolved or not, was judged visually after the solvent cooled to room temperature. The results are shown in Table 1 below. In the table, the numerical values refer to the percent dissolved.

TABLE 1

| Compound | Solvent: Methanol (%) | Ethanol (%) | Acetone (%) |
|---|---|---|---|
| 1 | 10 | 5 | 10 |
| 2 | 0.1 | 0.02 | 0.1 |
| 3 | 0.05 | 0.01 | 0.05 |
| 9 | 1 | 0.5 | 1 |
| A | 0.03 | 0.005 | 0.01 |

From the results shown in Table 1 above, it is apparent that the compounds according to the present invention have an excellent solubility in comparison with Compound A.

EXAMPLE 2

Onto a polyethylene terephthalate transparent support, the following layers were coated, as indicated below, to prepare seven kinds of light-sensitive sheets (A) to (G).

(1) A mordant layer containing the polymer (3.0 g/m$^2$) described in U.S. Pat. No. 3,898,088 and having the repeating unit indicated below:

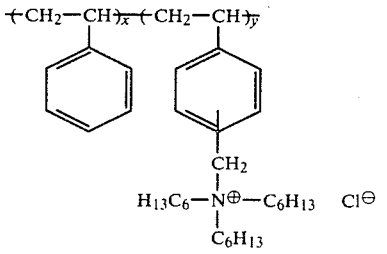

x : y = 50 : 50 and gelatin (3.0 g/m$^2$).

(2) A white reflective layer containing 20 g/m$^2$ of titanium oxide and 2.0 g/m$^2$ of gelatin.

(3) A light-shielding layer containing 2.70 g/m$^2$ of carbon black and 2.70 g/m$^2$ of gelatin.

(4) A layer containing the magenta DRR compound (0.45 g/m$^2$) indicated below, diethyllaurylamide (0.10 g/m$^2$), 2,5-di-t-butylhydroquinone (0.0074 g/m$^2$) and gelatin (0.76 g/m$^2$).

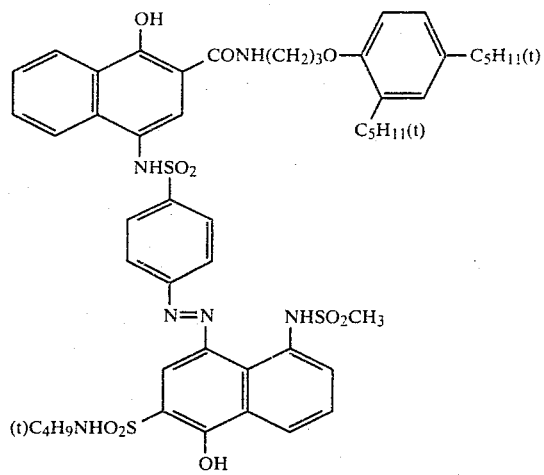

(5) A layer containing green sensitive internal latent image type direct positive silver iodobromide emulsion (internal latent image type emulsion prepared in the same manner as described in U.S. Pat. No. 3,761,276; halide composition in the silver halide: 2 mol% iodide; 1.4 g/m$^2$ calculated as the amount of silver, 1.0 g/m$^2$ of gelatin), sodium 5-pentadecyl-hydroquinone-2-sulfonate (0.11 g/m$^2$), and a fogging agent in an amount indicated below:

| Light-sensitive Sheet | Fogging Agent | Amount Added (ml/mol of Ag) |
|---|---|---|
| A | None | |
| B | Compound 1 | 2.1 |
| C | Compound 2 | 2.2 |
| D | Compound 3 | 2.5 |
| E | Compound 9 | 1.9 |
| F | Compound A | 2.0 |
| G | Compound A | 4.1 |

(6) A layer containing gelatin (0.94 g/m$^2$).

The above-described light-sensitive sheets (A) to (G) were processed in combination with each element shown below.

| Processing Solution: | | |
|---|---|---|
| 1-Phenyl-4-methyl-4-hydroxymethyl-3-pyrazolidone | 10 | g |
| Methylhydroquinone | 0.18 | g |
| 5-Methylbenzotriazole | 4.0 | g |
| Sodium Sulfite (anhydrous) | 1.0 | g |
| Carboxymethyl Cellulose Na Salt | 40.0 | g |
| Carbon Black | 150 | g |
| Potassium Hydroxide (28% aq. soln.) | 200 | cc |
| $H_2O$ | 550 | cc |

0.8 g of the processing solution of the above composition was filled into each pressure rupturable container.

Cover Sheet:

Onto a polyethylene terephthalate support were coated an acid polymer layer (neutralizing layer) containing 15 g/m$^2$ of polyacrylic acid (a 10 wt% aqueous solution having viscosity of about 1,000 cp), a neutralization timing layer containing 3.8 g/m$^2$ of acetyl cellulose (hydrolysis of 100 g of the acetyl cellulose froms 39.4 g of acetyl groups), and 0.2 g/m$^2$ of a styrene-maleic anhydride copolymer (composition (molar) ratio: styrene:maleic anhydride is about 60:40, molecular weight: about 50,000) thereon to thereby prepare a cover sheet.

Processing Step:

The above-described cover sheet was laminated on the above-described light-sensitive sheet. Exposure to light throughout a continuous wedge for 1/10 second was perfomred through a color test chart from the cover sheet side. Thereafter, the processing solution described above was spread between both sheets in a thickness of 75 microns (with assistance of a pressure roller). The processing was carried out at 25° C. After processing, the green density of the images formed on the image-receiving layer was measured 1 hour after the processing through the transparent support of the light-sensitive sheet using a Macbeth reflection densitometer. The results thereof are shown in Table 2.

It is apparent from the results shown in Table 2 that the compounds of the present invention act as excellent fogging agents.

Furthermore, the compounds according to the present invention exhibit excellent reversal properties in comparison with Compound A, even when a less amount is added.

TABLE 2

| Light-Sensitive Sheet | Mazimum Density | Minimum Density |
|---|---|---|
| A | 0.26 | 0.27 |
| B | 2.05 | 0.28 |
| C | 2.12 | 0.29 |
| D | 1.96 | 0.29 |
| E | 2.01 | 0.30 |
| F (Comparative Sample) | 1.80 | 0.28 |
| G (Comparative Sample) | 2.03 | 0.28 |

It is apparent from the results shown in Examples 1 and 2 described above that the compounds according to the present invention exhibit excellent solubility to a solvent and excellent reversal properties even when small amounts are used.

While the invention has been described in detail and with reference to specific embodiments thereof, it will be apparent to one skilled in the art that various changes and modifications can be made therein without departing from the spirit and scope thereof.

What is claimed is:

1. A direct positive silver halide photographic light-sensitive material comprising a support having coated thereon an internal latent image emulsion layer which contains a light-sensitive silver halide of the type that is not previously fogged and a hydrophilic colloid layer, at least one of said layers containing a compound represented by the formula (I) in an amount which gives a suitable maximum density when the light-sensitive material is developed by a surface developing solution

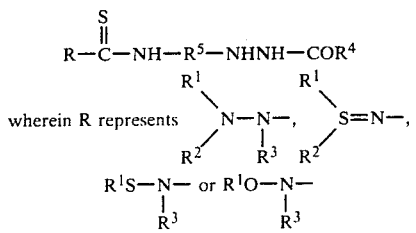

wherein $R^1$ represents $R^6$ or $R^6CO$—; and $R^6$ represents an aliphatic group, an aromatic group, a heterocyclic aromatic group or hydrogen; $R^2$ and $R^4$, which may be the same or different, each represents an aliphatic group, an aromatic group, a heterocyclic aromatic group or hydrogen; or $R^1$ and $R^2$ together can form a ring; $R^3$ represents hydrogen or an aliphatic group; $R^5$ represents Y or X—A—Y wherein X and Y, which may be the same or different, each represents a divalent aromatic group, and A represents a divalent connecting group selected from —CONH—, NHCONH—, —$SO_2$NH—, —B—CONH— and —B—$SO_2$NH— wherein B represents —E—, —O—E— or —S—E— wherein the O and S is bonded to X; and E represents a divalent aliphatic group.

2. A direct positive silver halide photographic light-sensitive material as in claim 1, wherein said compound of formula (I) is present in an amount of from about 0.1 mg to 1,000 mg per mol of silver halide.

3. A direct positive silver halide photographic light-sensitive material as in claim 1, wherein said compound of formula (I) is present in an amount of from 0.5 mg to 700 mg per mol of silver halide.

4. A direct positive silver halide photographic light-sensitive material as in claim 1, 2, or 3, wherein said silver halide emulsion layer is spectrally sensitized to red, green or blue light.

5. A direct positive silver halide photographic light-sensitive material as in claim 1, 2, or 3, wherein said emulsion layer contains a sensitizing dye selected from the group consisting of cyanine dyes, merocyanine dyes, complex cyanine dyes, complex merocyanine dyes, holopolar cyanine dyes, styryl dyes, hemicyanine dyes, oxonol dyes and hemioxonol dyes.

6. A direct positive silver halide photographic light-sensitive material as in claim 1, 2, or 3, wherein said light-sensitive silver halide photographic emulsion layer is associated with a diffusible dye releasing dye image providing material including an o-hydroxyarylsulfamoyl group.

7. A direct positive silver halide photographic light-sensitive material as in claim 2, or 3, wherein said compound of the formula (I) is incorporated in said internal latent image emulsion layer.

8. A direct positive silver halide photographic light-sensitive material as in claim 1, 2, or 3, wherein said emulsion layer or adjacent hydrophilic colloid layer contains a diffusible dye-releasing dye-image-providing material.

9. A direct positive silver halide photographic light-sensitive material as in claim 1, 2, or 3, wherein said aliphatic group for $R^2$ and $R^6$ in the formula (I) is an alkyl group, an alkenyl group or an alkynyl group.

10. A direct positive silver halide photographic light-sensitive material as in claim 9, wherein $R^2$ and $R^6$, which may be the same or different, are selected from an unsubstituted alkyl group or an alkyl group substituted with an alkoxy group, a halogen atom, an alkoxycarbonyl group, or an aryl group.

11. A direct positive silver halide photographic light-sensitive material as in claim 1, 2, or 3, wherein $R^2$ and $R^6$, which may be the same or different, are selected from a phenyl group, a naphthyl group, or a phenyl or naphthyl group substituted with an alkyl group, an alkoxy group, a dialkylamino group, an alkoxycarbonyl group, a cyano group, or a halogen atom.

12. A direct positive silver halide photographic light-sensitive material as in claim 1, 2, or 3, wherein $R^2$ and $R^6$, which may be the same or different, are selected from a 5-membered or 6-membered aromatic heterocyclic ring containing at least one of an oxygen atom, a nitrogen atom and a sulfur atom, or is a condensed ring.

13. A direct positive silver halide photographic light-sensitive material as in claim 1, 2, or 3, wherein the aliphatic group for $R^3$ is an alkyl group.

14. A direct positive silver halide photographic light-sensitive material as in claim 13, wherein the alkyl group for $R^3$ is an unsubstituted alkyl group or an alkyl group substituted with an alkoxy group, an alkoxycarbonyl group, an aryl group, an amido group or an acyloxy group.

15. A direct positive silver halide photographic light-sensitive material as in claim 1, wherein $R^4$ is hydrogen, a methyl group, an ethyl group, an n-propyl group, an isopropyl group, an isobutyl group, or a phenyl group which may be substituted.

16. A direct positive silver halide photographic light-sensitive material as in claim 1, 2, or 3, wherein X and Y, which may be the same or different, are selected from a meta-phenylene group or a paraphenylene group.

17. A direct positive silver halide photographic light-sensitive material as in claim 1, wherein R represents

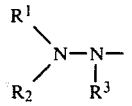

wherein $R^1$ and $R^2$, which may be the same or different, each represents hydrogen, a methyl group, an ethyl group, an isobutyl group, a t-octyl group, or a phenyl group which may be substituted; $R^3$ represents hydrogen or an alkyl group; or $R^1$ and $R^2$ together form a ring.

18. A light-sensitive material as in claim 1, further containing a hydrazide or hydrazine type compound or a heterocyclic quaternary salt compound as other type of fogging agent.

19. A light-sensitive material as in claim 18, wherein the molar ratio of the other type of fogging agent to the compound of formula (I) ranges from about 1 to about 500.

20. A light-sensitive material as in claim 19, wherein the molar ratio of the other type of fogging agent to the compound of formula (I) ranges from 10 to 300.

* * * * *